US005564604A

United States Patent [19]

Tada

[11] Patent Number: 5,564,604

[45] Date of Patent: Oct. 15, 1996

[54] MANUALLY OPERATED TRIGGER TYPE DISPENSER

[76] Inventor: Tetsuya Tada, 2-6-3 Kakinokizaka, Megro-ku, Tokyo, Japan

[21] Appl. No.: 278,443

[22] Filed: Jul. 21, 1994

[30] Foreign Application Priority Data

Aug. 6, 1993 [JP] Japan ..... 5-213571

[51] Int. Cl.[6] ..... B67D 5/33

[52] U.S. Cl. ..... 222/153.14; 222/382; 222/383.1

[58] Field of Search ..... 222/153.01, 153.14, 222/324, 340, 341, 382, 383.1; 239/333

[56] References Cited

U.S. PATENT DOCUMENTS

| | | | |
|---|---|---|---|
| 3,927,834 | 12/1975 | Tada | 239/359 |
| 4,022,352 | 5/1977 | Pehr | 222/153.14 |
| 4,153,203 | 5/1979 | Tada | 239/333 |
| 4,230,277 | 10/1980 | Tada | 239/33 |
| 4,346,821 | 8/1982 | Wesner et al. | 222/153 |
| 4,463,905 | 7/1984 | Stoesser et al. | 239/329 |
| 4,506,805 | 3/1985 | Marcon | 222/383.1 X |
| 4,516,695 | 5/1985 | Garneau | 222/153.14 |
| 4,558,821 | 12/1985 | Tada et al. | 239/333 |
| 4,606,480 | 8/1986 | Rodriguez-Gazulla | 222/341 |
| 4,815,663 | 3/1989 | Tada | 239/333 |
| 4,852,770 | 8/1989 | Sledge | 222/153.14 |
| 4,958,754 | 9/1990 | Dennis | 222/383 |
| 5,373,991 | 12/1994 | Nelson | 239/333 |

*Primary Examiner*—Joseph A. Kaufman

*Attorney, Agent, or Firm*—Frishauf, Holtz, Goodman, Langer & Chick

[57] ABSTRACT

A hook is formed on the rear surface of a nozzle cover. A cantilever is formed on the front surface of a nozzle and extends forward. An engaging portion engageable with the hook, such as another hook is formed on the upper surface of the cantilever. The hook of the nozzle cover is disengaged with the hook of the cantilever by pushing the cantilever and bending the cantilever downward.

14 Claims, 6 Drawing Sheets

MANUALLY OPERATED TRIGGER TYPE DISPENSER

BACKGROUND OF THE INVENTION

1. Field of the Invention

The present invention relates to a manually operated trigger type dispenser attached to the mouth of a container, sucking liquid from the container into a cylinder and pressurizing and causing the liquid to flow out by reciprocation of a piston cooperating with traction of trigger, and also relates to a child proof mechanism.

2. Description of the Prior Art

The problem of destroying the ozone layer is now a great problem. Hence, dispensers which use no freon gas to pressurize liquid, and which are manually operated to pressurize and force out liquid, are drawing more and more attention. In the dispenser of this kind, a dispenser body is connected to the mouth of a container holding liquid to be dispensed by means of a connecting member such as a bottle cap, and a cylinder is integrally formed on the dispenser body, for example.

A trigger is pivotably attached to the dispenser body, and a piston is reciprocated in the cylinder in cooperation with traction of the trigger against an urging force of a return spring. When the piston is returned from the pushed-in position to the initial position, the interior of the cylinder is negatively pressurized. Then, a primary valve is opened and a secondary valve is closed. When the trigger is released, it is returned to the initial position by the urging force of the return spring, and the piston is also returned to the initial position in cooperation with the trigger. Under the negative pressure in the cylinder, the liquid is sucked from the container into the cylinder through the primary valve as the liquid excludes residual air in the cylinder. Upon pulling the trigger against the return spring, the piston is pushed into the cylinder to pressurize the liquid in the cylinder. The pressurized liquid opens the secondary valve and flows from the cylinder into a flowing-out passage formed in the dispenser body through the second valve. A cylindrical blind-ended nozzle formed separately from the dispenser body is provided at the front end of the passage. A spinner (a swirling member) is housed in the nozzle. The pressurized liquid presses the spinner against the rear bottom surface of the nozzle, is swirled by the spinner and flows out of an orifice (or a flow-out port) of the front surface of the nozzle as a spray flow. When the use of the dispenser is interrupted, the liquid is sucked up into the cylinder and is retained in it. When the trigger is pulled again, the pressurized liquid flows out immediately.

Normally, all the components of a dispenser such as a dispenser body, a trigger a piston and a nozzle are injection molded from a plastics material.

Since the dispenser is connected to the mouth of a container, the level of the center of the gravity of the container having the dispenser connected thereto is inevitably high and it becomes unstable as the level of the liquid in the container becomes reduced. If the container falls by mistake, the trigger is likely to hit against something to cause the liquid to flow out and some accident may happen. The traction force required for operating the trigger is not very large Even a child such as a baby can pull the trigger. If the child pulls the trigger by mistake, the liquid which has flowed out may enter an eye or the eyes of the child and/or adheres to the skin of the child and an accident is likely to occur.

A manually operated trigger type dispenser is provided with an accident preventing mechanism called a child proof mechanism in order to prevent an accident of this kind. In General, the child proof mechanisms are classified into two types, one which locks a trigger itself and forcibly prevents the trigger from swinging as disclosed in U.S. Pat. Nos. 4,558,821 (Tada) and 3,927,834 (Tada), and the other in which the orifice of a nozzle is covered with a nozzle cover in liquid tightness as disclosed in U.S. Pat. Nos. 4,406,480 (Gazulla) and 4,815,663 (Tada). In the child proof mechanism of a trigger lock type, a holder of the trigger must be provided on the dispenser body and an engaging hole for the holder must be formed in the trigger. This makes the structure of the accident preveting mechanism complicated and deteriorates its appearance.

As shown in FIGS. 6 and 7(A) and 7(B), a manually operated trigger type dispenser 110 provided with a nozzle cover type child proof mechanism has a nozzle cover 138, a nozzle cover 130 and a hinge 136 connecting the nozzle cover 138 to the nozzle 130. The nozzle 130, the nozzle cover 138 and the hinge 136 are integrally molded from a plastics material. An orifice 134 is formed in the substantially center of the front surface of the nozzle 130, and a cylindrical portion 140 which closely contacts the orifice 134 and ensures liquid tightness is formed on the rear surface (inner surface) of the nozzle cover 138. The nozzle cover 138 can be fixed to nozzle 130 irrespective of whether or not the orifice 134 is covered with the nozzle cover 138. As shown in FIG. 7(A), the nozzle cover 138 is rotated in the direction of an arrow and is pushed into a despression 111 formed in the front surface of nozzle 130. Then, an engaging piece 113 on the rear surface of the nozzle cover 138 is held between holding portions 115 and 117, and the cylindrical portion 140 closely contacts the front surface of the orifice 134 to cover the orifice 134 in liquid tightness (see FIGS. 6 and 7(B)). As shown in FIG. 7(B), the nozzle cover 138 is rotated in the direction of an arrow and pressed against the upper surface of the nozzle 130. Then, the cylindrical portion 138*a* on the front surface of the nozzle cover 138 engages an engaging groove 130*c* in the upper surface of the nozzle 130 so that the nozzle cover 138 is fixed to the nozzle 130. A trigger 112 has an upper end fitted in the lateral wall of a dispenser body and is connected to the dispenser body so as to rotate around a pivot 122. The trigger 112 is pressed against the rear surface of the nozzle 130 by the urging force of a return spring so that the initial position of the trigger is set.

Even if the container happens to fall by mistake and the trigger is swung, or a child happens to move the trigger mischievously, liquid is prevented from flowing out and thus an unexpected accident can be avoided when the orifice 134 is covered with the nozzle cover 138 in liquid tightness. Since the nozzle cover 138 is fixed to the upper surface of the nozzle 130, pressurized liquid from the orifice 134 does not hit against the nozzle cover 138 and is not scattered while the dispenser is being used.

Apparently, the shape of the child proof mechanism including a nozzle cover becomes complicated a little but its number of parts does not increase. The nozzle cover is held on the front surface of nozzle when the orifice of the nozzle is covered with the nozzle cover. Thus, the appearance is not deteriorated. When the orifice of the nozzle is not covered, the nozzle cover can engage the upper surface of the nozzle cover. Therefore, the dispenser gives no strange impression and no poor appearance. Recently, therefore, child proof mechanisms of a nozzle cover type have been generally used.

With the conventional dispenser provided with a child proof mechanism of a nozzle cover type, the operator holds the lower end portion of the nozzle cover 138 with the finger and pulls it toward him or her. When the pulling force (the traction force) is larger than the force which holds the nozzle cover (the holding force or locking force), the nozzle cover is released immediately and the orifice 134 of the nozzle 130 is opened.

It is well known that, with the conventional dispenser, the child proof mechanism is released by pulling the nozzle cover. A child can release the child proof mechanism very easily, and thus the dispenser is apt to lose its child proof function.

SUMMARY OF THE INVENTION

It is accordingly an object of the present invention to provide a manually operated trigger type dispenser and a child proof mechanism in which the child proof mechanism cannot be released even when the nozzle cover is pulled in the well known manner.

In order to achieve the object of the present invention, attention is paid to an elastic force which separates a nozzle cover from a nozzle naturally and the present invention has a structure that the nozzle cover is released by being pushed instead of by pulling.

For example, a hook is formed on the rear surface of the nozzle cover and a cantilever having a hook engageable with the hook of the nozzle cover is formed on the front surface of the nozzle. When the cantilever is bent downward by pushing, the hooks are disengaged from each other.

DETAILED DESCRIPTION OF THE PREFERRED EMBODIMENTS

Embodiments of the present invention will be described in detail with reference to the accompanying drawings.

Figure 1:
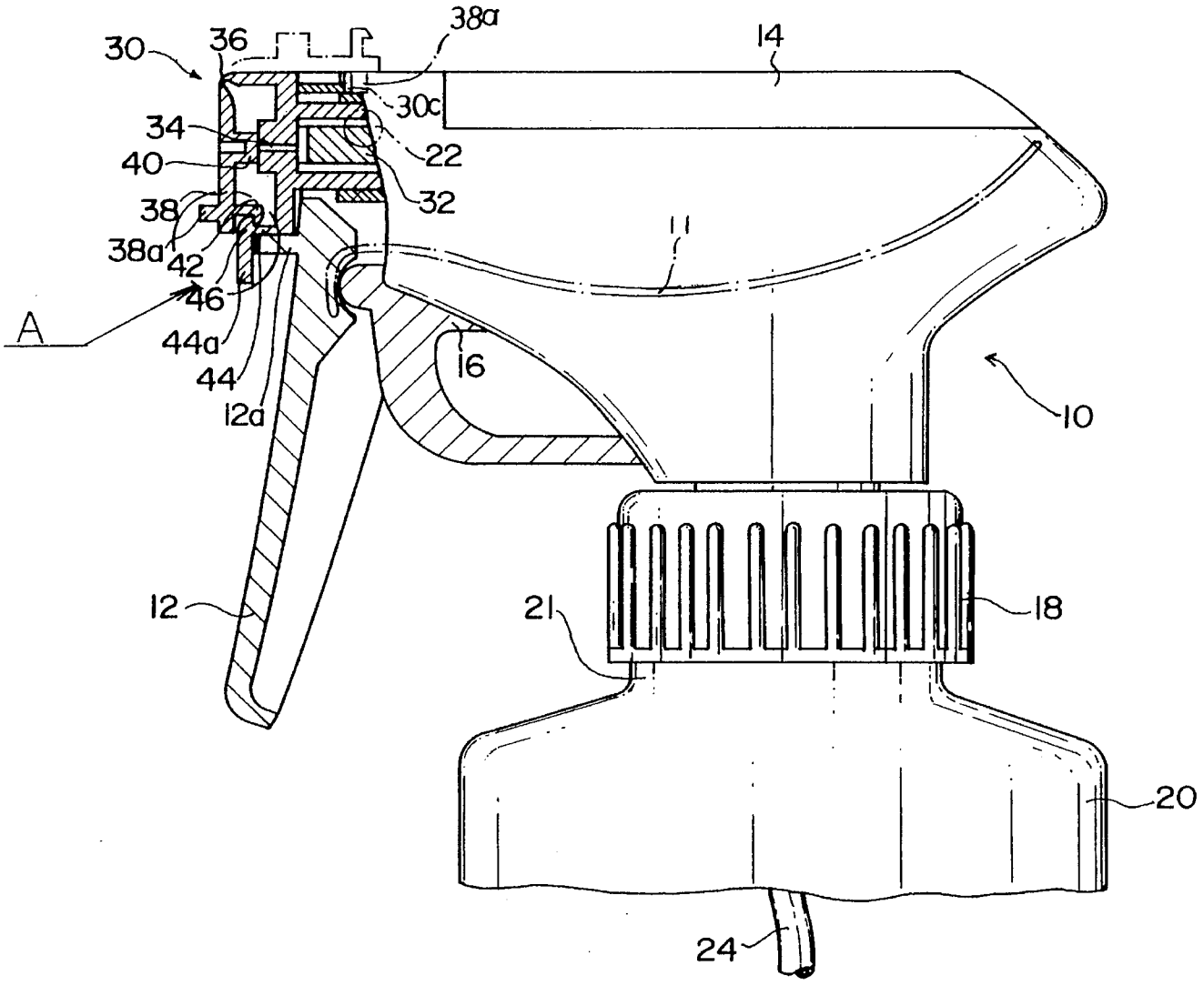
FIG. 1 is a partially broken side view of a manually operated trigger type dispenser according to one embodiment of the present invention.

As shown in FIG. 1, a manually operated trigger type dispenser 10 according to the present invention is provided with a trigger 12 pressed by the urging force of a return spring 11 so as to be set at an outer initial position. The trigger 12 is fitted in the lateral wall of a dispenser body 14 so as to rotate or swing. A pivot is shown at 22. The trigger 12 is interconnected to a piston 16 so that the piston 16 is reciprocated in a cylinder in response to the swinging of the trigger 12. The dispenser body 14 is threadably engaged with the mouth 21 of a container 20 by means of a bottle cap 18. As the piston 16 is reciprocated in the cylinder, liquid in the container 20 is sucked up into the cylinder through a suction tube 24 and a primary valve, and is compressed. The pressurized liquid flows out of the cylinder through a secondary valve and flows through a flowing-out passage formed in the dispenser body. A nozzle 30 is fitted in the front end of the passage of the dispenser body 14, and a spinner (or a swirling member) 32 is housed in the nozzle 30. The pressurized liquid is swirled by the spinner 32 and is jetted, as a spray, out of an orifice (flowing-out port) 34 formed in the substantially central portion of the front surface of the nozzle 30.

Since the internal stucture of the manually operated trigger type dispenser 10 is identical with the conventional one, the details thereof are omitted because it does not fall in the scope of the present invention. Such a structure of a conventional dispenser is disclosed in U.S. Pat. No. 4,815,663 (Tada).

For example, the nozzle 30 has a tubular portion 30*a* (FIG. 2) disposed at the rear side and fitted in a tubular portion forming the flowing-out passage of the dispenser body 14. A projection 30*b* formed on the upper surface of the nozzle 30 is engaged with an engaging hole correspondingly formed in the upper surface of the dispenser body 14. The nozzle 30 is non-rotationally fixed to the dispenser body 14 by abutting the upper portion of the rear surface and the right and left end portions of the nozzle 30 against the front end of the dispenser body 14. The nozzle 30 is provided with a nozzle cover 38 molded from a plastics material and connected to the nozzle 30 by a hinge 36. When a cylidrical portion 40 formed on the rear surface of the nozzle cover 38 closely contacts an orifice 34 formed on the front surface of the nozzle 30 and covers the orifice 34 in liquid tightness, the liquid is prevented from flowing out of the orifice 34.

Figure 2:
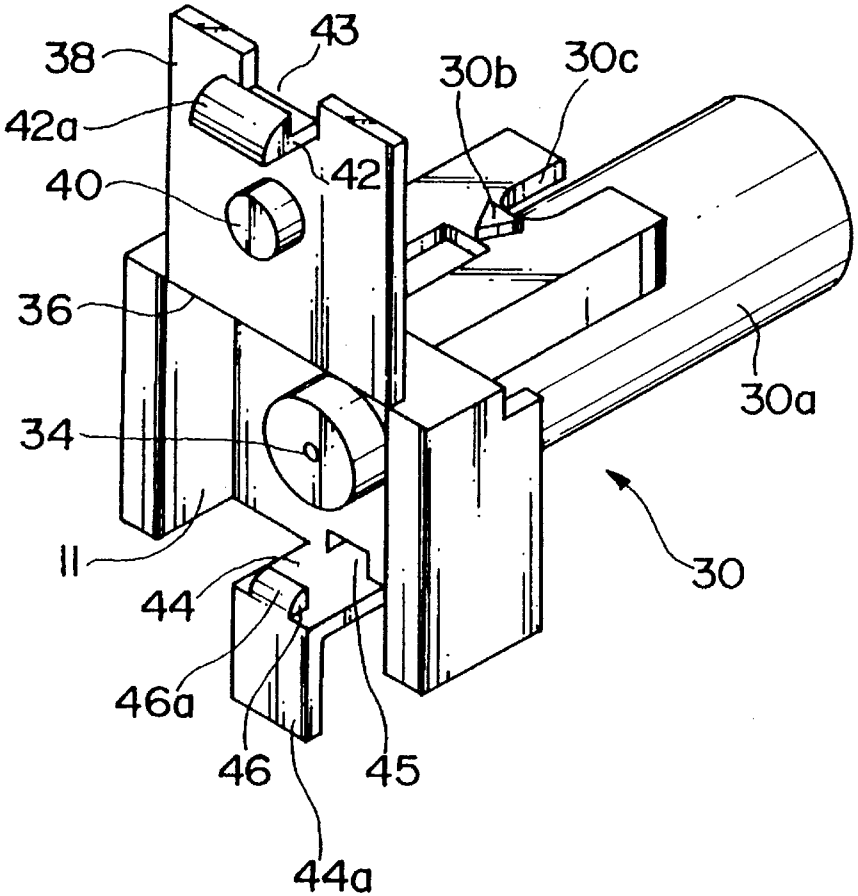
FIG. 2 is an enlarged perspective view of a nozzle incorporated into the dispenser shown in FIG. 1.

As seen from FIG. 2 in addition to FIG. 1, according to the present invention, a hook 42 is formed on a portion of the rear surface of the nozzle cover 38 which is adjacent to its lower edge. The hook 42 has two walls 42*b*, 42*c* (FIG.3) which cross at a right angle to each other. A cantilever 44 extending forward is formed on the front surface of the nozzle 30 and a downward extending bent portion 44*a* is formed on the front end of the cantilever 44. Notches 43 and 45 are formed adjacent to the cantilever 44 so as to facilitate molding. An engaging portion such as a hook 46 with which the hook 42 of the nozzle cover 38 is engaged is formed on the upper surface of the cantilever 44. The hooks 42 and 46 have arcuate shoulder surfaces 42*a* and 46*a*, respectively, for example.

Figure 3:
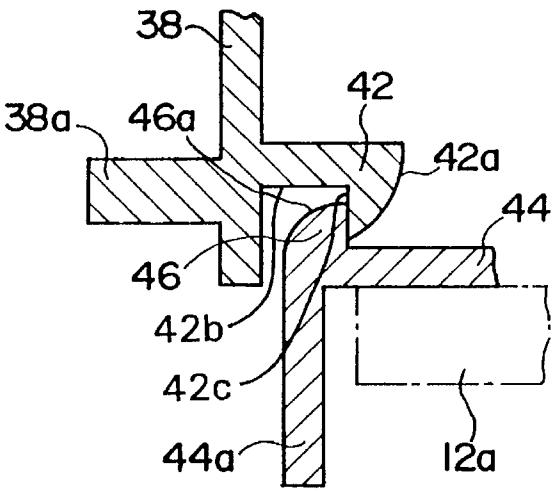
FIG. 3 is an enlarged view of the part A in FIG. 1.

As shown in FIG. 2, when the nozzle hinge 38 is folded forward and is pushed into a space 11 in the front surface of the nozzle 30 by rotating in the counterclockwise left direction, the arcuate shoulder surfaces 42*a* and 46*a* abut against each other and the hook 42 and the cantilever 44 flex or bend to allow the hook 42 to ride over the hook 46 of the cantilever 44. Thereafter, the hook 42 and the cantilever 44 regain their original shape, and the hooks 42 and 46 engage each other, as shown in FIG. 3. In a state in which the hooks 42 and 46 engage each other, the cylindrical portion 40 on the rear surface of the nozzle cover 38 closely contacts the orifice 34 on the front surface of the nozzle 30 and covers the same in liquid tightness, as shown in FIG. 1, whereby the liquid is prevented from flowing out of the orifice 34. By pushing the downward extending bent portion 44*a* on the front end of the cantilever 44 for the use of the dispenser, the cantilever 44 is bent or flexed and the hook 46 of the cantilever 44 is removed from the position opposed to the hook 42

In the construction in which the nozzle 30 and the nozzle cover 38 connected to the nozzle 30 by the hinge 36 are integrally molded from a plastics material, an inherent elastic force for setting the nozzle cover 38 to a non-restrictive natural state is applied to the nozzle cover 38. When the hook 46 of the cantilever 44 is moved from the position opposed to the hook 42, the hook 42 is sprung upward by the inherent elastic force to open the orifice 34. In other words, the hook 42 of the nozzle cover 38 and the hook 46 of the cantilever 44 are disengaged from each other automatically by pushing the bent portion 44*a*. After disengagement, the operator places his finger on the lower end of the nozzle cover 38 and rotates the nozzle cover 38 in the clockwise direction around the hinge 36 in FIG. 1, such that the cylindrical portion 38*a* of the front surface of the nozzle cover 38 is engaged with the engaging groove 30*c* formed in the upper surface of the nozzle 30 to fix the nozzle cover 38. Thus, the nozzle cover 38 does not hinder the pressurized liquid from flowing out of the orifice 34 during the operation of the dispenser 10.

In the conventional dispenser of this kind, the liquid tightness of the orifice is released only by pulling the nozzle cover and the liquid can flow out immediately. In the present invention, on the other hand, the cantilever 44 is pushed instead of being pulled as is in the conventional case. If the cantilever 44 is not pushed, the orifice 34 is not released from the liquid tight state. Thus, even when the container 20 falls by mistake or a child pulls the nozzle cover 38 of the dispenser 10, the liquid does not flow out easily.

In this way, a child proof condition is released not by the well known pulling operation (traction) of the nozzle cover but by the pushing operation of the cantilever 44 which is contrary to the conventional pulling operation and cannot be anticipated by the prior art. Thus, the child proof condition of the dispenser is ensured.

The following advantages of the child proof condition attained by the nozzle cover are retained in the present invention:

(1) the molding is performed without difficulty;

(2) the number of components does not increase; and (3) the nozzle cover can be engaged with the upper surface of the nozzle easily even when the orifice of the nozzle is not covered.

In the above-describe embodiment, the downward extending bent portion 44*a* is formed on the front end of the cantilever 44. Thus, the cantilever 44 is pushed and bent downward easily. This allows the hooks 42 and 46 to be disengaged from each other rapidly. However, the structure of the cantilever 44 is not always limited to the above-mentioned one but may be any other structure. For example, the cantilever 44 may have such a large length that it extends beyond the notch 43 of the nozzle cover 38 even when the hooks 42 and 46 are engaged with each other. Further, the cantilever 44 may have a step portion extending under the lower end of the nozzle cover 38 not to abut against the nozzle cover 38.

Figure 4A:
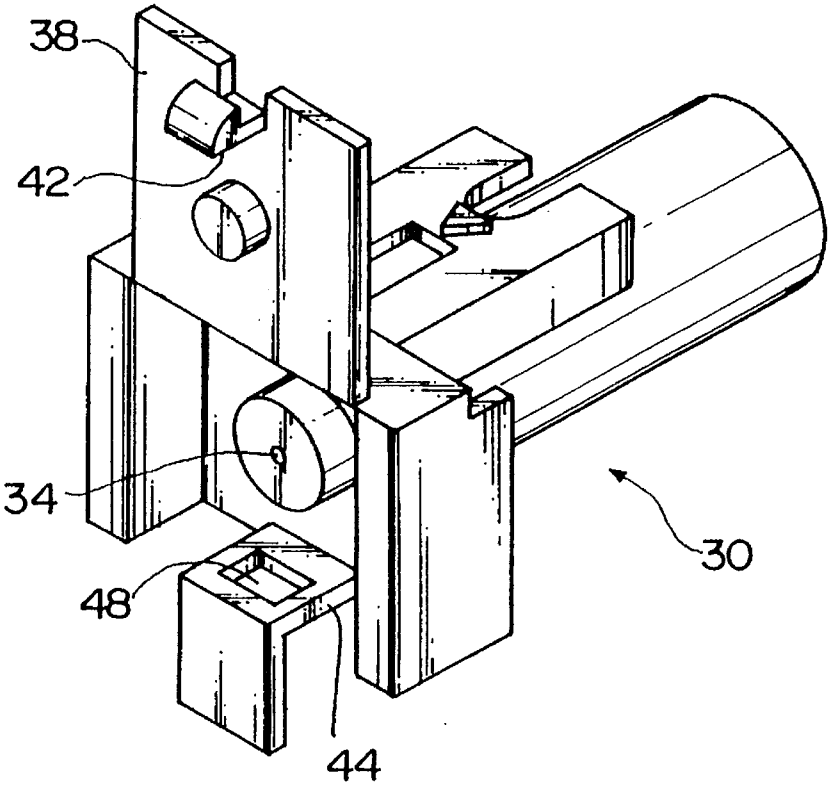
FIGS. 4(A) and 4(B) are enlarged perspective views, each showing a nozzle of a further embodiment of the present invention, and wherein the nozzle corresponds to the nozzle of FIG. 2.
Figure 5B:
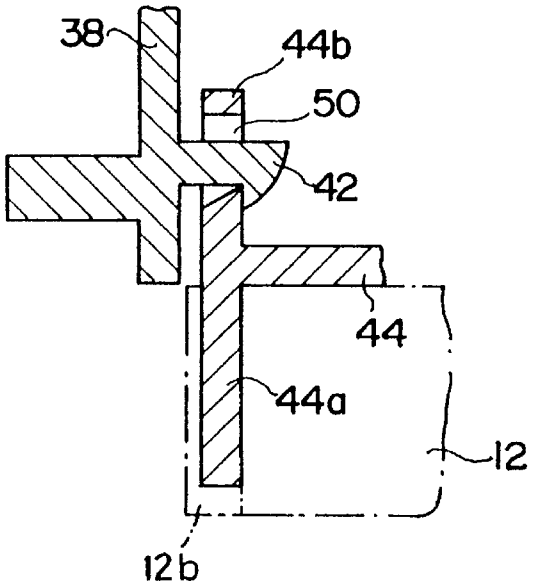
FIGS. 5(A) and 5(B) are partially broken enlarged views, each showing a nozzle as shown in FIGS. 4(A) and 4(B)
Figure 5A:
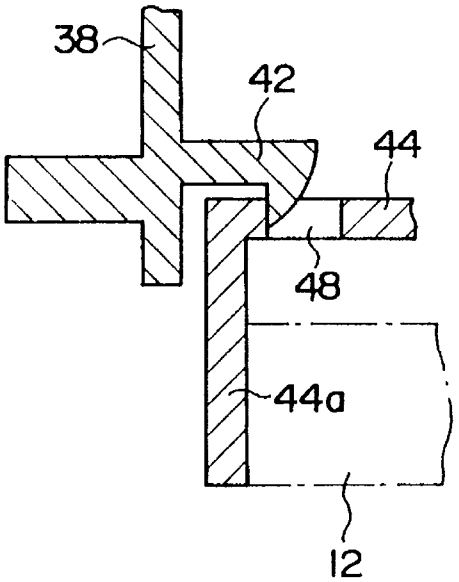
Figure 4B:
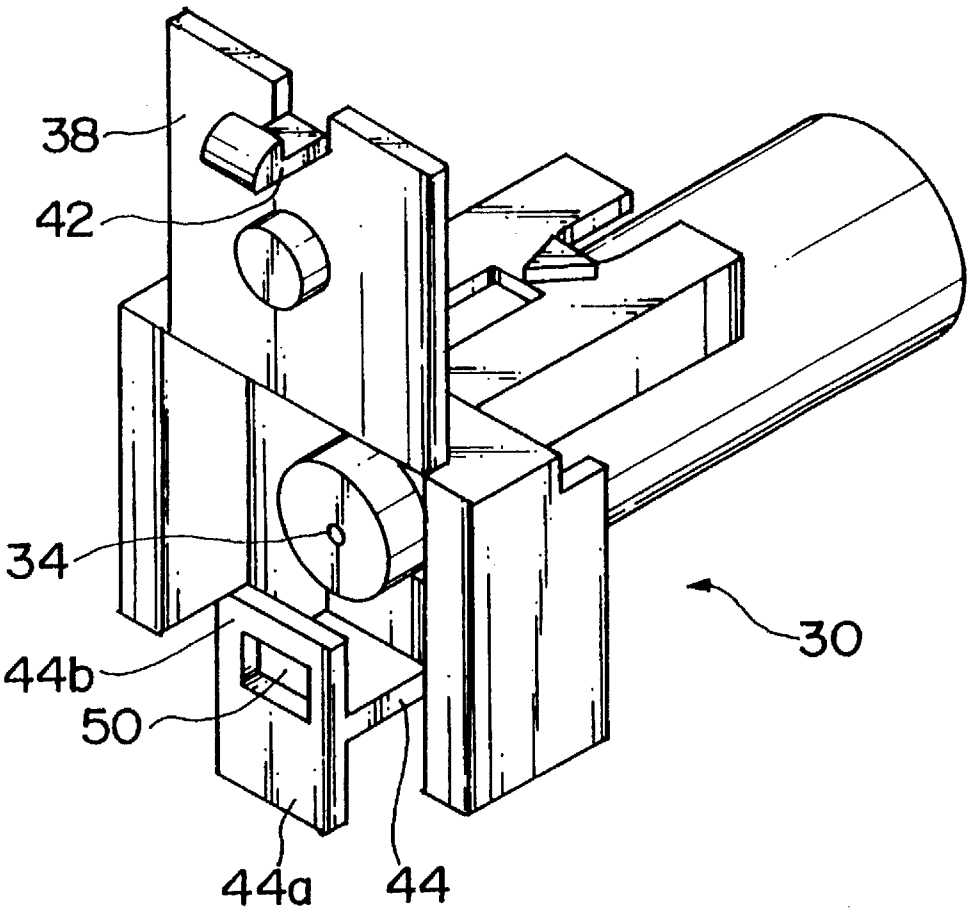
Figure 6:
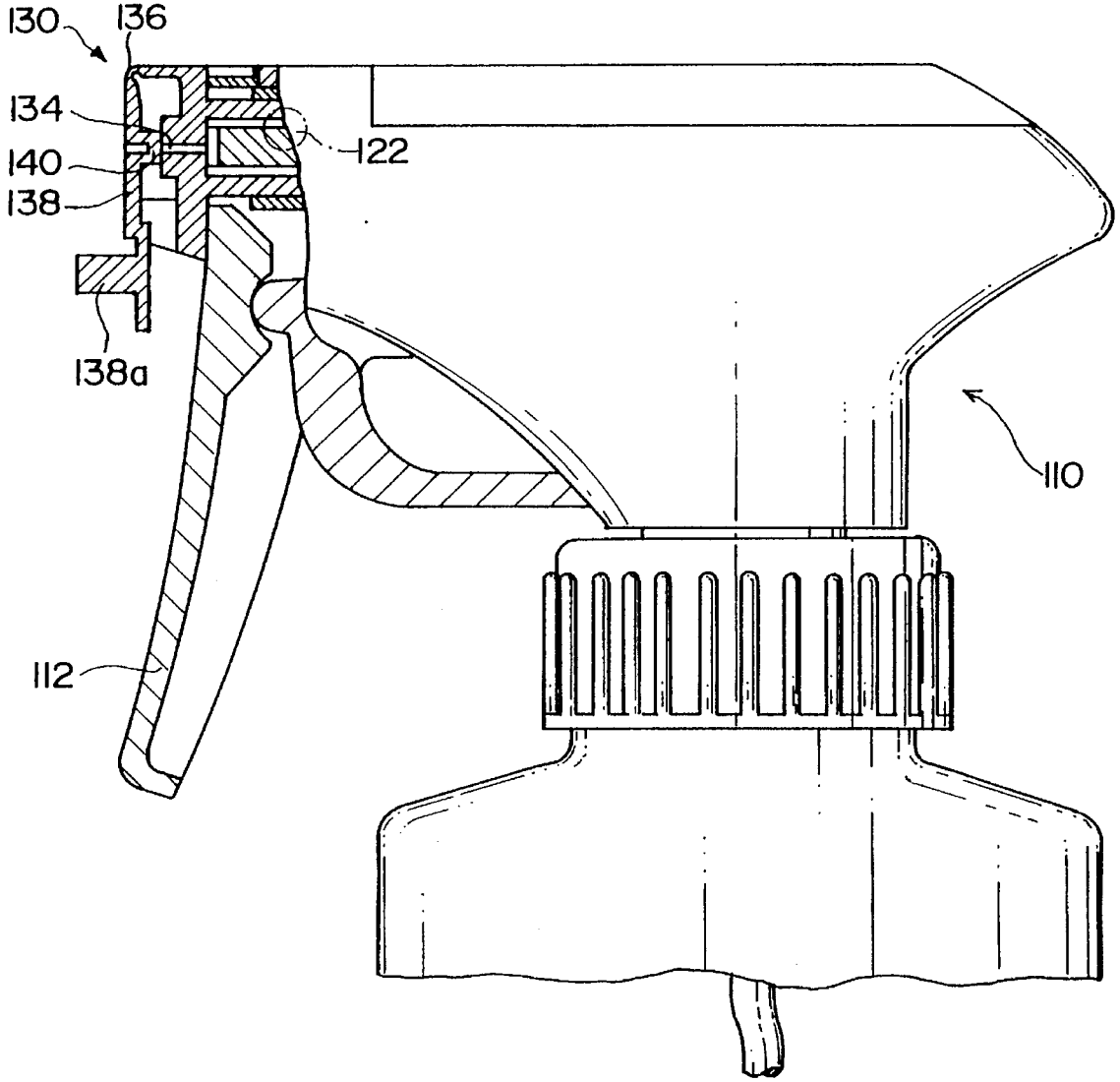
FIG. 6 (PRIOR ART)
FIG. 6 is a partially broken side view of a conventional manually operated trigger type dispenser.
Figures 7A, 7B:
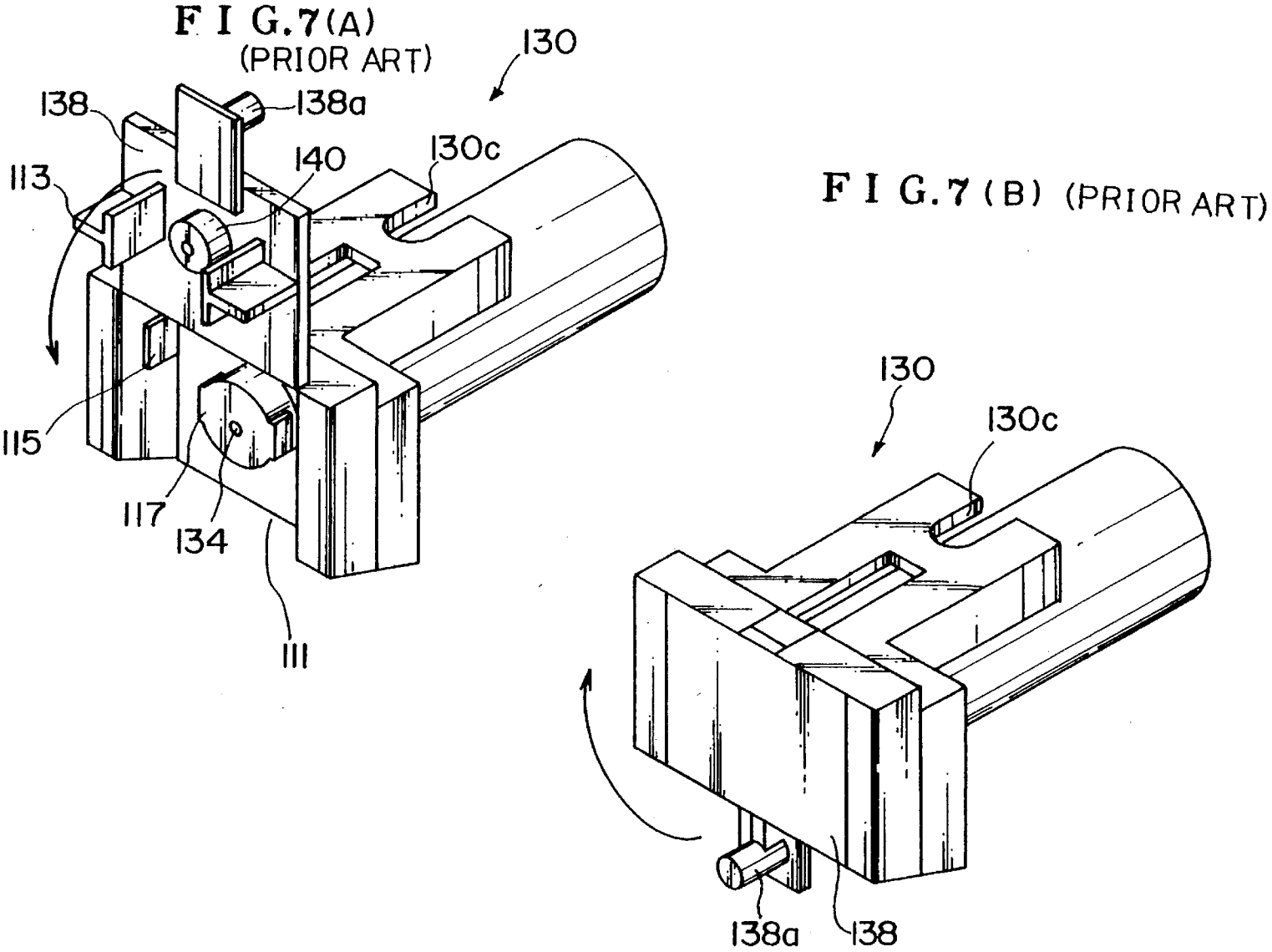
FIG. 7(B) (PRIOR ART)
FIG. 7(A) (PRIOR ART)
FIGS. 7(A) and 7(B) are enlarged perspective views of the dispenser shown in FIG. 6.

The engaging potion of the cantilever which is engaged with the hook 42 is not limited to the hook 46 but any other structure may be adopted. As shown in FIGS. 4(A) and 5(A), for example, the hook 42 may be engaged with an engaging hole 48 formed in the cantilever 44. Further, as shown in FIGS. 4(B) and 5(B), an upward extending bent portion 44*b* may be formed on the front end of the cantilever 44 and the hook 42 may be engaged with an engaging hole 50 formed in the bent portion 44*b*. The engaging hole 50 is a through hole in FIGS. 4(B) and 5(B), but may be a blind hole.

The front surface of the trigger 12 may be disposed behind the cantilever 44 at the initial position of the trigger 12 so that the cantilever 44 is prevented from being bent downward in order not to disengage the hook 42 of the nozzle cover 38 and the engaging portion of the cantilever 44 from each other. As shown by one-dotted chain lines in FIGS. 1 and 3, for example, a projection 12*a* is formed on the front surface of the trigger 12 so that the trigger 12 directly abuts against the lower surface of the cantilever 44 by the urging force of the return spring 11 to set the initial position of the trigger 12.

Since the projection 12*a* on the front surface of the trigger 12 abuts against the lower surface of the cantilever 44, downward bending of the cantilever 44 is prevented. Thus, the engagement and disengagement between the hook 42 of the nozzle cover 38 and the hook 46 of the cantilever 44 are prevented by the projection 12*a* of the trigger 12. When the operator uses the dispenser 10, the trigger 12 is pulled to move the projection 12*a* downward to create a space behind the cantilever 44 so that the cantilever 44 can be bent downward. Then, pushing of the downward extending bent portion 44*a* of the cantilever 44 bends or flexes the cantilever 44 downward to move the hook 46 of the cantilever 44 outside of the position opposing the hook 42 of the nozzle cover 38.

The structure of preventing the cantilever 44 from being pushed by the projection 12*a* of the trigger 12 provides such an advantageous effect in that liquid tightness is maintained unless the cantilever 44 is pushed after the trigger 12 is pulled. With the dispenser which requires two steps to operate, the liquid does not flow out easily when the container 20 falls by mistake or a child touches the dispenser. In other words, even if the container 20 provided with the dispenser 10 falls by mistake, there is only a small possibility that the traction of the trigger 12 and the pushing of the cantilever 44 will occur accidentally and simultaneously. When a child plays with a dispenser 10 according to the present invention, unexpected flow-out of the liquid is fully prevented because he or she cannot pull the trigger 12 and push the cantilever 44 simultaneously. Two operation steps as described above improve a child proof function or an accident preventing function greatly. Although the easiness of usage is slightly sacrificed, this inconvenience occurs merely at the time of the engagement and disengagement. However, this causes no problem to the operator of the dispenser 10, and the dispenser 10 can be used in the same way as in the conventional way.

In this embodiment, the trigger 12 is abutted against the lower surface of the cantilever 44 so as to prevent the cantilever 44 from being bent downward, but the structure of preventing the bending of the cantilever 44 is not limited thereto. The front surface of the trigger 12 may be abutted against the rear surface of the downward extending bent portion 44*a*, as shown in FIG. 5(A), or a depression 12*b* surrounding the downward extending bent portion 44*a* may be formed in the front surface of the trigger 12, as shown in FIG. 5(B), so as to prevent the bending of the cantilever 44.

In this embodiment, the initial position of the trigger 12 is set by abutting the trigger 12 against the cantilever 44, but the present invention may have a structure which provides a little space between the cantilever 44 and trigger 12. Such a structure may be attained by abutting the trigger 12 against the rear surface of the nozzle 30 instead of abutting the trigger 12 against the cantilever 44 so that a little space is left in order to prevent the bending of the cantilever 44 and the front surface of the trigger 12 is disposed just behind the lower surface of the cantilever 44 or just behind the downward extending bent portion 44*a*.

The above-mentioned embodiments are only examples which explain the present invention and do not limit the scope of the present invention. Needless to say, various modifications and alterations are possible as long as they fall within the scope of the present invention.

What is claimed is:

1. A manually operated trigger type dispenser provided with a child proof mechanism which prevents a pressurized liquid from flowing out by covering an orifice on a front surface of a nozzle in liquid tightness with a nozzle cover connected to the nozzle by a hinge, the nozzle cover and the nozzle being integrally molded from a plastics material, the dispenser being operated so that the liquid is sucked into a cylinder and compressed by reciprocation of a piston in cooperation with swinging of a trigger and a pressurized liquid flows out of the orifice on the front surface of the nozzle, the child proof mechanism comprising:

a cantilever formed on the front surface of the nozzle, the cantilever having a flexible portion which extends forward and horizontally of the nozzle, the flexible portion being downwardly bendable;

a hook formed on a rear surface of the nozzle cover, the hook including a portion having two walls crossing at right angles to each other; and an engaging portion formed on the forward and horizontally extending cantilever portion, the engaging portion being engaged with at least one of the two walls of the hook when the orifice of the nozzle is covered with the nozzle cover in liquid tightness, and the engaging portion being disengaged from the hook when the forward and horizontally extending cantilever portion is bent downward.

2. A manually operated trigger type dispenser according to claim 1, wherein the engaging portion of the cantilever comprises a hook formed on an upper surface of the forward and horizontally extending cantilever portion, and including two walls crossing at right angles to each other.

3. A manually operated trigger type dispenser according to claim 1, wherein the engaging portion of the cantilever comprises an engaging hole formed in an upper surface of the cantilever.

4. A manually operated trigger type dispenser according to claim 1, wherein the cantilever comprises an upward extending bent portion on a front end thereof, and the engaging portion of the cantilever comprises an engaging hole formed in the upward extending bent portion.

5. A manually operated trigger type dispenser according to claim 1, wherein the trigger has a front surface portion which is disposed behind the forward and horizontally extending cantilever portion at an initial position of the trigger so as to block the forward and horizontally extending cantilever portion from being bent downward, and wherein when the trigger is pulled by an operator, a space is provided for bending the forward and horizontally extending cantilever portion downward.

6. A manually operated trigger type dispenser according to claim 1, wherein the trigger abuts against a rear surface of the cantilever to set an initial position of the trigger.

7. A manually operated trigger type dispenser provided with a child proof mechanism which prevents a pressurized liquid from flowing out by covering an orifice on a front surface of a nozzle in liquid tightness with a nozzle cover connected to the nozzle by a hinge, the nozzle cover and the nozzle being integrally molded from a plastics material, the dispenser being operated so that the liquid is sucked into a cylinder and compressed by reciprocation of a piston in cooperation with swinging of a trigger and a pressurized liquid flows out of the orifice on the front surface of the nozzle, the child proof mechanism comprising:

a cantilever formed on the front surface of the nozzle, the cantilever having flexible portion which extends forward and horizontally of the nozzle, the flexible portion being downwardly bendable;

the forward and horizontally extending cantilever portion having a downwardly extending bent portion on a front end portion thereof, the bent portion extending downward beyond a lower end of the nozzle cover;

a hook formed on a rear surface of the nozzle cover, the hook including a portion having two walls crossing at right angles to each other and an arcuate shoulder surface; and an engaging portion formed on the forward and horizontally extending cantilever portion, the engaging portion being engaged with at least one of the two walls of the hook when the orifice of the nozzle is covered with he nozzle cover in liquid tightness, and the engaging portion being disengaged from the hook when the bent portion of the cantilever is pushed forward toward the nozzle to thereby bend the forward and horizontally extending cantilever portion downward to release the hook.

8. A manually operated trigger type dispenser according to claim 7, wherein the trigger abuts against a rear surface of the downward extending bent portion to set an initial position of the trigger.

9. A manually operated trigger type dispenser according to claim 7, wherein the engaging portion of the cantilever comprises a hook formed on an upper surface of the forward and horizontally extending cantilever portion, and including two walls crossing at right angles to each other.

10. A manually operated trigger type dispenser according to claim 7, wherein the engaging portion of the cantilever comprises an engaging hole formed in an upper surface of the cantilever.

11. A manually operated trigger type dispenser according to claim 7, wherein the cantilever comprises an upwardly extending bent portion on a front end thereof, and the engaging portion of the cantilever comprises an engaging hole formed in the upwardly extending bent portion.

12. A manually operated trigger type dispenser according to claim 7, wherein the trigger has a front surface portion which is disposed behind the forward and horizontally extending cantilever portion at an initial position of the trigger so as to block the forward and horizontally extending cantilever portion from being bent downward, an wherein when the trigger is pulled by an operator, a space is provided for bending the forward and horizontally extending cantilever portion downward.

13. A manually operated trigger type dispenser according to claim 7, wherein the trigger abuts against a rear surface of the cantilever to set an initial position of the trigger.

14. A child proof mechanism for a manually operated trigger type dispenser connected to a mouth of a container and sucking a liquid from the container into a cylinder, compressing the liquid and causing pressurized liquid to flow out by reciprocation of a piston in cooperation with swinging of a trigger, the child proof mechanism comprising:

a nozzle cover connected to a nozzle by a hinge and covering an orifice of a front surface of the nozzle in liquid tightness so as to prevent flowing out of the pressurized liquid, the nozzle cover and the nozzle being integrally molded from a plastics material;

a cantilever formed on the front surface of the nozzle and having a flexible portion extending forward and horizontally of the nozzle, the flexible portion being downwardly bendable, and a front end of the forward and horizontally extending cantilever portion having a bent portion extending downward beyond a lower end of the nozzle cover;

a hook formed on a rear surface of the nozzle cover, and including two walls crossing at right angles to each other and an arcuate shoulder surface; and an engaging portion formed on the forward and horizontally extending cantilever portion, the engaging portion being engaged with the hook when the orifice of the nozzle is covered with the nozzle cover in liquid tightness and being disengaged from the hook when the forward and horizontally extending cantilever portion is bent downward responsive to a pushing force applied to the bent portion.

* * * * *